United States Patent [19]

Tsai

[11] Patent Number: 4,512,041

[45] Date of Patent: Apr. 23, 1985

[54] DISPENSING DEVICE

[76] Inventor: Tseng B. Tsai, No. 118, La. 526, Ta-Tung Rd., Tainan, Taiwan

[21] Appl. No.: 543,010

[22] Filed: Oct. 18, 1983

[51] Int. Cl.[3] ..... E03D 9/02

[52] U.S. Cl. ..... 4/227

[58] Field of Search ..... 4/225, 227, 228

[56] References Cited

U.S. PATENT DOCUMENTS

| | | | |
|---|---|---|---|
| 915,629 | 3/1909 | Shipp et al. | 4/227 |
| 1,365,642 | 1/1921 | Amann | 4/227 |
| 2,644,167 | 7/1953 | Gordon | 4/227 |
| 4,296,503 | 10/1981 | Leardi | 4/228 |
| 4,370,763 | 2/1983 | Dolan | 4/228 |

*Primary Examiner*—Charles E. Phillips

*Attorney, Agent, or Firm*—Cushman, Darby and Cushman

[57] ABSTRACT

This invention provides a dispensing device for toilet tank. It dispenses a liquid cleanser substantially in a predetermined quantity during each flushing cycle. The dispensing device comprises a float and a container disposed adjacently under the float for holding the cleanser; a dispensing member fitted in the outlet of the container, which includes vertical and transverse passage defining tortuous passages for discharging a substantially measured liquid cleanser when the dispensing device is automatically pivoting to an inverted position relative to its normally mounting position caused by a decrease of buoyance in a flushing cycle, and will restore to the normally mounting position when the water level rises again.

2 Claims, 8 Drawing Figures

DISPENSING DEVICE

BACKGROUND OF THE INVENTION

This invention relates to a device for discharging cleanser liquid into a toilet tank and is particularly concerned with a dispensing device capable of being supported within the toilet tank and adapted to be periodically conditioned for releasing a predetermined quantity of cleanser liquid into the toilet tank during a flushing cycle.

As a rule, a toilet flush tank usually has water therein under the control of a manually operable valve which can be opened to discharge the tank water to a toilet bowl, after which the tank is filled up for a new flush cycle. It is desirable to discharge into a flush tank during flushing a small quantity of a liquid from a container, such liquid being used either for sterilizing purposes, neutralizing unpleasant odors, or other purposes.

Many of the known designs of dispenser for use in connection with toilet tank utilizing the variation in air pressure which automatically actuate and control the dispensing operation. However, the normal operation of which is maintained in a normal condition of the toilet tank, if a breakdown is met by the flushing mechanism of the toilet tank or the water supply accidentally ceases for some reasons. The contents of these known dispenser will be inevitably exhausted before long. Other disadvantages that this invention is intended to overcome will become apparent as the description proceeds.

SUMMARY OF THE INVENTION

A general object of the invention is to provide an improved dispenser adapted to be positioned to discharge within the flush tank for a toilet and wherein a discharge of a predetermined quantity of the liquid within the dispenser is effected automatically and without the use of valves or similar mechanical parts.

A further object of the invention is to provide an improved dispenser adapted to be positioned within the flush tank for a toilet and discharges liquid therefrom substantially only when the flushing is normally operated.

In order to achieve the foregoing objects as well as other incidental objects and advantages, the invention comprises a container including an imperforated first chamber and a second chamber associated with the first chamber yet not communicated therewith for storing liquid to be dispensed, the second chamber formed with an extending portion extended through the imperforated first chamber and including a tortuous passage which includes a outlet orifice, with which a quantity of liquid defined by the dimension of the tortuous passage will dispense from the orifice into the toilet tank and replenished by the liquid left in the remaining portions of the tortuous passage during each flushing cycle; an adjustable mounting means being such detachably mounting and pivotably connected with the second chamber at two ends thereof that the upper end of the extending portion is disposed above the highest flush water level within a toilet tank, as well as the first chamber and the second chamber will pivot as a whole during flushing of the toilet, to dispense a predetermined quantity of liquid defined by the dimension of the tortuous passage when restoring to its normally mounting position until the occurence of next flushing cycle.

Preferably, the tortuous passage is formed in a detachable dispensing member which is mounted in the outlet end of the extending portion, and includes a plurality of continuously radially extending transverse and vertical passage sections which providing additional resistance to the liquid cleanser contained in the second chamber, thereby there is only a predetermined portion of the liquid cleanser filled in the tortuour passage will discharge into the toilet tank during a flushing cycle.

BRIEF DESCRIPTION OF THE DRAWINGS

The invention will now be described in connection with the drawings wherein.

DETAILED DESCRIPTION OF THE PREFERRED EMBODIMENTS

As illustrated in the accompanying drawings, numeral 14 denotes a flush tank such as employed with a conventional type of flush system for toilets wherein the tank 14 is automatically refilled to a desired water level after each flushing operation.

Figure 1:
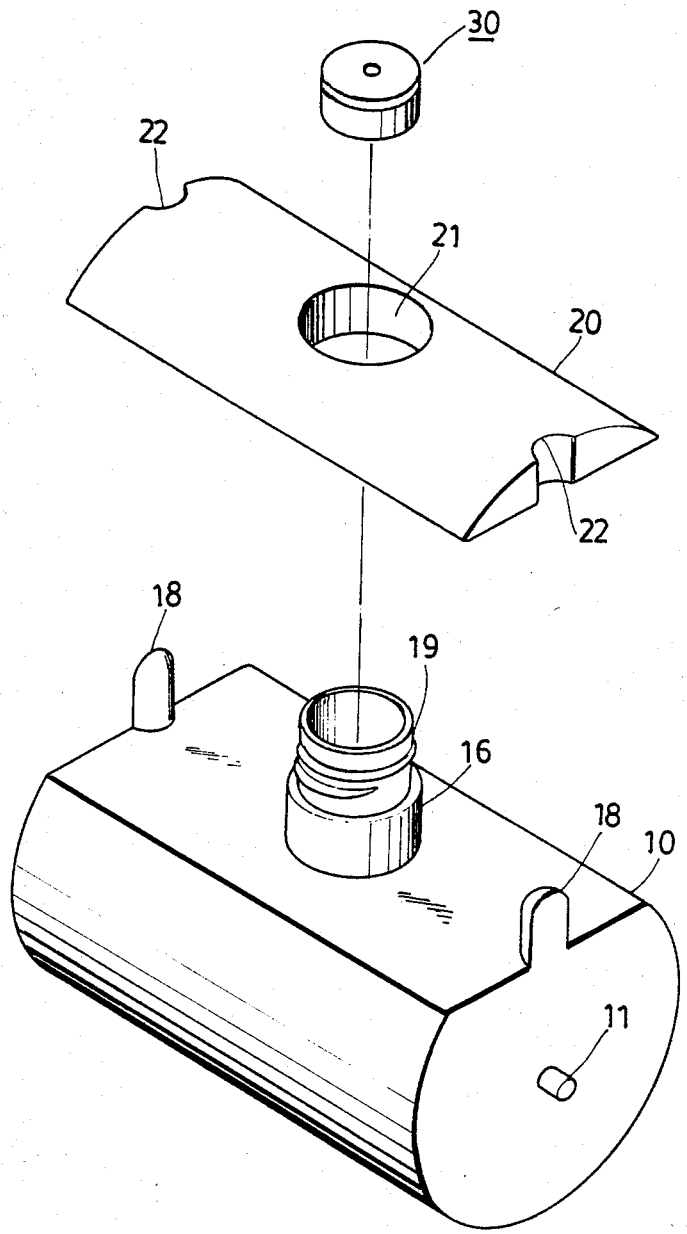
FIG. 1 is an exploded view of a dispensing device according to this invention.
Figure 2:
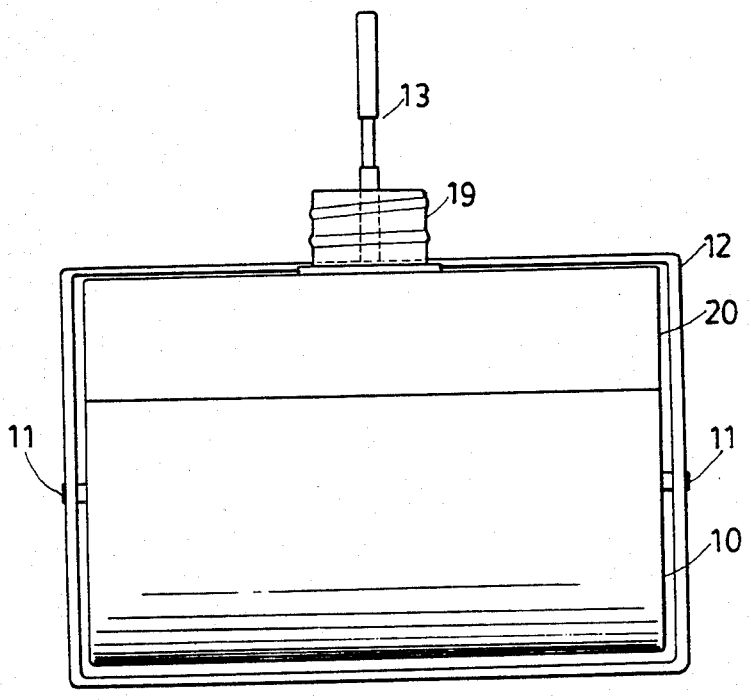
FIG. 2 is an elevation of a dispensing device similar to which shown in FIG. 1 but in assembled condition.

Referring now to FIG. 1, the dispensing device as herein embodied comprises a container 10 made of rigid plastic or other light material being centered on the upper wall of the container 10, a neck portion 16 in succession with a threaded extension 19 of less diameter is formed integrally. A complementary hollow part 20 of the container 10 is correspondingly formed with a hole 21 to receive the neck portion 16 through, the threaded extension 19 is extended outwardly when the complementary part is rested on the container 10 to complete a dispenser with substantially cylindrical appearence. For localizing the complementary part 20 on the upper surface of the container 10, a pair of projections 18,18 respectively provided on the upper surface of the container 10, the complementary part 20 is formed with a pair of recesses 22,22 to engage with the pair of projections 18,18.

On the two end surfaces of the container 10, there are a pair of pivotal pins 11,11 respectively formed, in order to achieve the advantage in operation, the pivotal pins 11, 11 are preferred to dispose eccentrically, specifically, being disposed under the center points of the opposite end surfaces of the cylindrical dispensing device.

Figure 3:
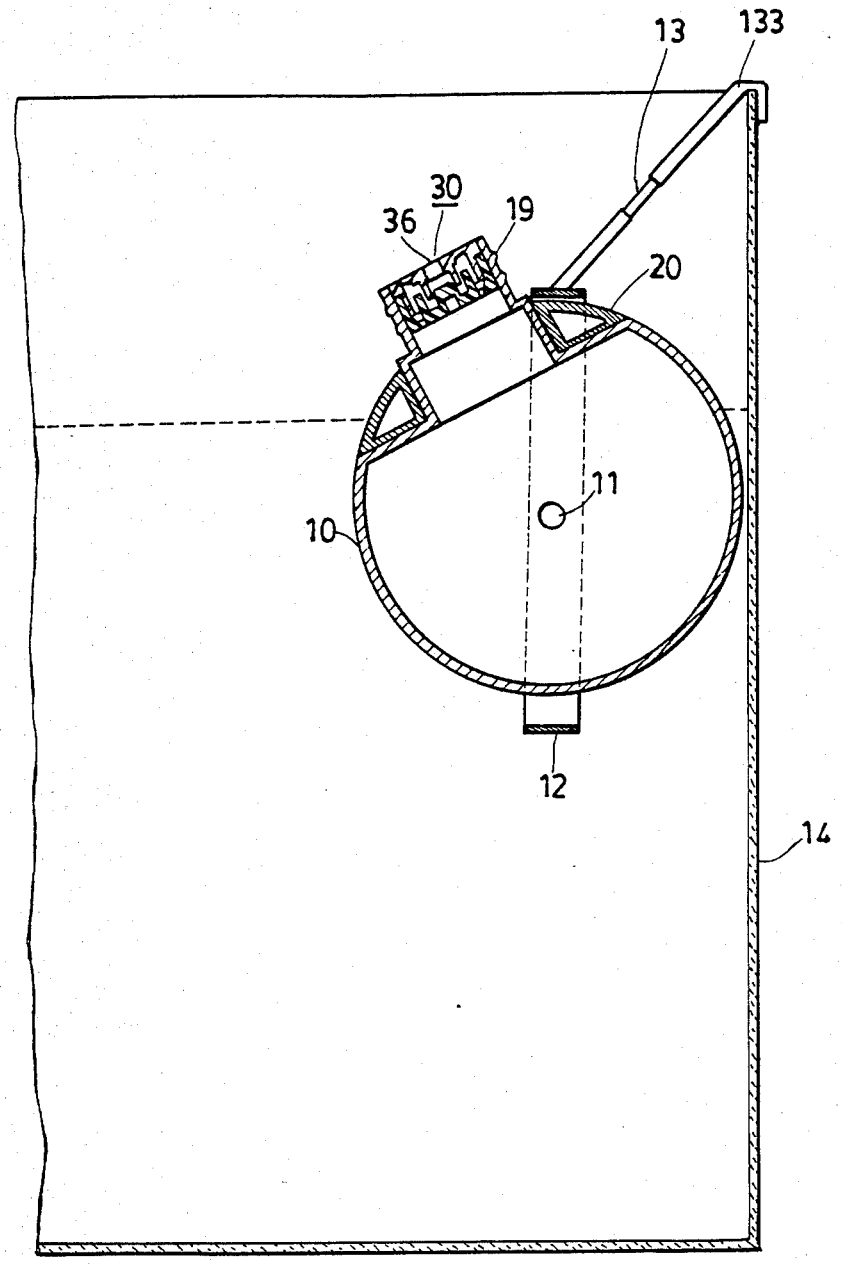
FIG. 3 shown a fragmentary sectional elevation of a flush tank filled with water in normal stand-by scondition and having suitably suspended therein a dispensing device according to this invention.

A rectangular bracket 12, which may be made of metal or other suitable material is mounted on the eccentrical pivotal pins 11,11 and permits pivoting of the former with respect to the latter. The bracket 12 includes an elongated member 13 which can be adjusted by the length thereof and provided at the upper end with a hook 133 to engage over the upper edge of the side wall of the tank 14, the length of elongated member 13 is adjusted such that the upper portion of the threaded extension 19 is maintained above the highest water level of the tank 14, and with its central axis offsetted from the inner wall of tank 14 which it leans on. The inclination of the dispensing device relative to the inner wall is about 30. By such arrangement, the buoyance of water in stand-by condition of the tank 14 and the weight of the dispensing device constitute couple of forces which involves a restoration tendency relative to the dispensing device, while such tendency is restrained by the bracket 12, in resulted that the dispensing device is steadily hold in the inclined position as illustrated in FIG. 3.

Figure 5:
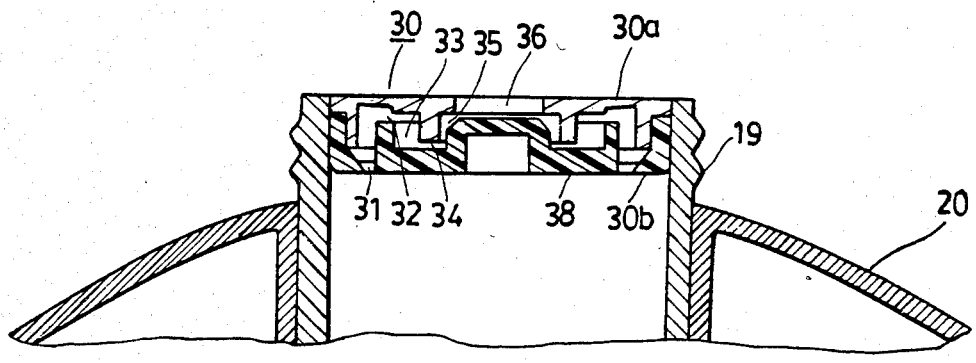
FIG. 5 is an enlarged longitudinal section view of the dispensing member of the dispensing device according to this invention.
Figure 6:
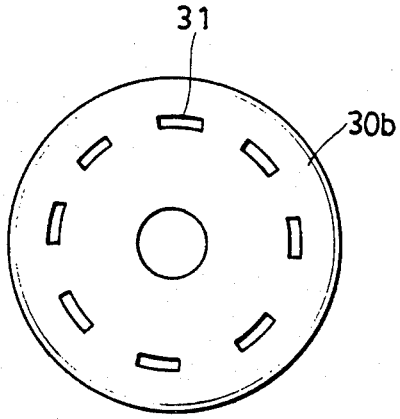
FIG. 6 is a bottom view of the dispensing member shown in FIG. 5.

As best shown in FIG. 5, a dispensing member 30 having two halves 30*a*,30*b* is fitted in the outlet of the threaded portion 19. The dispensing member 30 comprises radially extending transverse and vertical passages, the passages are communicated with each other to cooperatively define a tortuous or labyrinth-like lumen within the dispensing member 30. It can be seen in FIG. 5, a first passage section 31 extended vertically including a downwardly tapered opening terminates in the lower surface 38 of the dispensing member 30, above the widest portion of the tapered opening a upwardly extending opening having less diameter is extended successively, the first passage section 31 terminates in a laterally extended second passage section 32; the second passage section 32 is stepped and turned down to connect with a third passage section 33, the third passage section 33 terminates in a narrowed fourth passage section 34 extended laterally, the fourth passage 34 terminates in a fifth passage section 35 which extends upwardly and includes a divergent portion, through each divergent portion all passage sections are merged in an outlet portion 36 centered on the dispensing member 30.

The dispensing member 30 constructed in this manner can offer resistance to the liquid contained in the container 10, which combines with other factors discussed in the following will achieve the desired dispensing.

Figure 4:
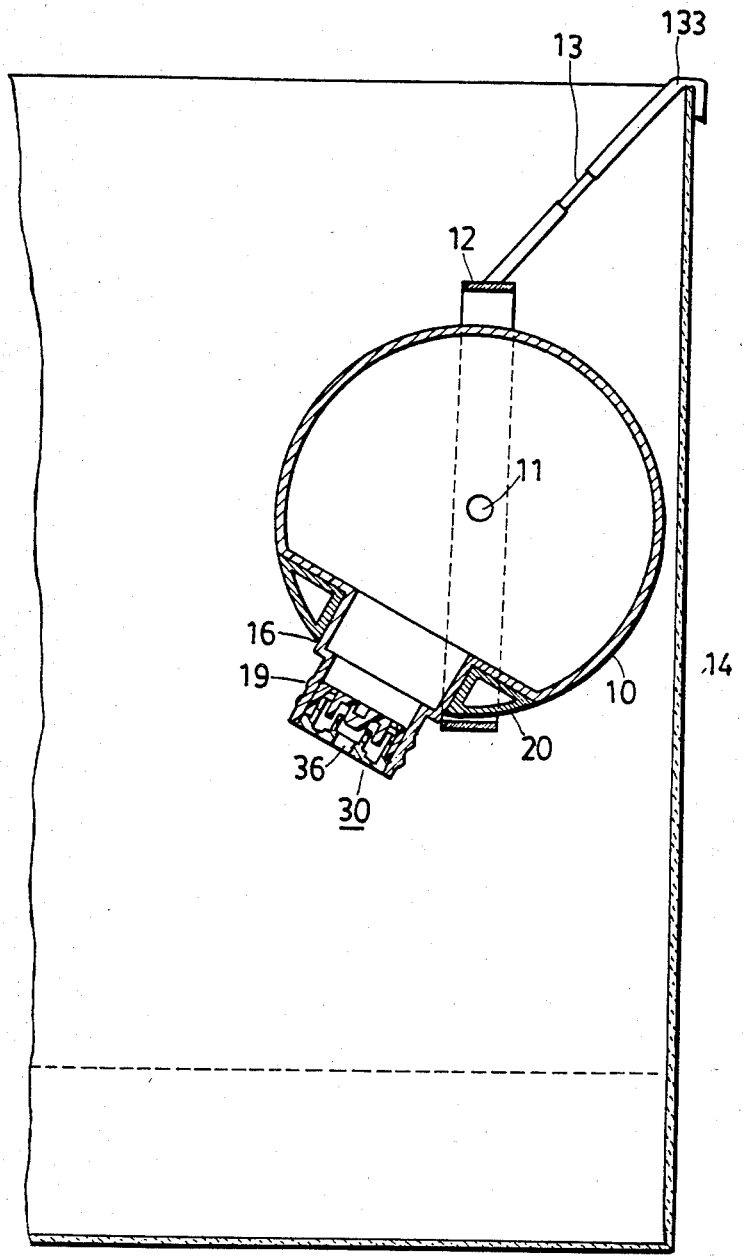
FIG. 4 shows the same dispensing device illustrated in FIG. 3 but the flush tank having been cycled with the water therein at a lower level and with the dispensing device inverted in such condition.

In flushing, the water within the toilet tank 14 rapidly drops to approximately the lower level indicated at 50 shown in FIG. 4. When the water level descending to an extent that the buoyance is decreased to not sufficient to cancel the weight of the dispensing device, the dispensing device will pivot counterclockwise and ultimately invert itself because the left side is heavier than the right side.

As pivoting of the dispensing device according to this invention, the liquid contained in the container 10 will flow into the lumen of dispensing member 30. By means of the radial acceleration created on downward motion of the dispensing device, the liquid filled in the outlet portion 36 will discharge therefrom and drop into the toilet tank 14 until the liquid gathered in the outlet portion 36 and the five passage sections are exhausted.

Having outlet portion 36 fine enough in relation to the length of such outlet as well as the viscosity and surface tension of liquid within container 10, the liquid flowing into the outlet portion 36 after the inverted position of the dispensing device had been achieved is normally held against discharge by a partial vacuum within the container 10 above the liquid level and thus there will be substantially no discharge in the inverted position. Therefore, the quantity dispensed is substantially predetermined by the volume of the outlet portion 36.

When the water commences to rise and the water rises to a certain level upon the next filling of the tank 14, the dispensing device is subjected in a buoyance and will pivot to its normally mounting position automatically.

By proper control of factors mentioned above such as the diameter of outlet portion, the viscosity and surface tension of liquid, a substantial range of quantity of liquid discharged from container 10 may be effected, all within a flushing cycle and a sufficient number of flushing cycles may be provided so that the dispensing device need not be replenished with detergent or the like for two or three months with normal use of a toilet.

Figure 7:
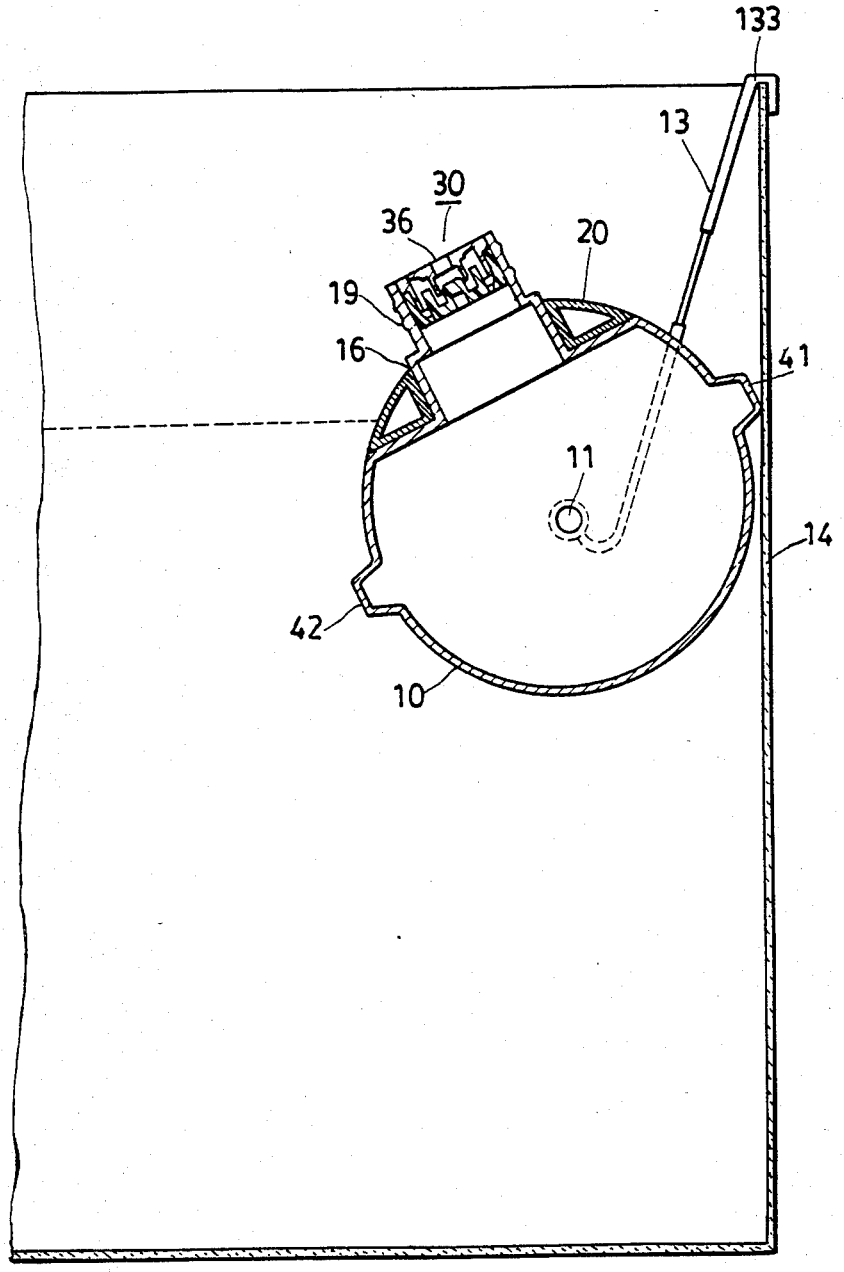
FIG. 7 shows another embodiment of the dispensing device according to this invention, which is suspended in the flush tank and in a stand-by condition.
Figure 8:
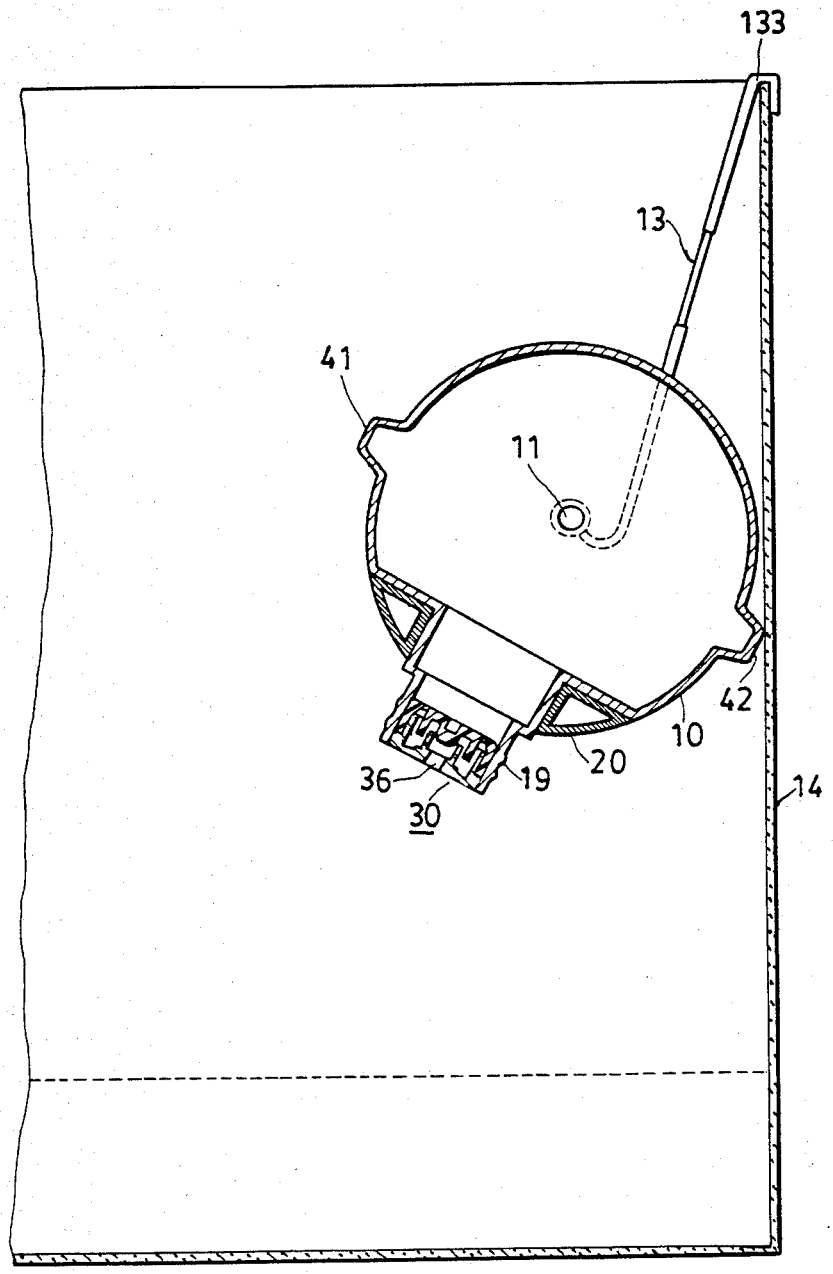
FIG. 8 shows the same embodiment illustrated in FIG. 7 but the flush tank having been cycled with the water therein and with the dispensing device inverted in such condition in absence of buoyance.

An alternate embodiment of this invention is shown in FIG. 7 and FIG. 8, a pair of protrusion 41,42 are adopted in place of the retangular bracket 12, in detail, the protrusion 41 and protrusion 42 substantially centered on opposite circumferencial surfaces of the container 10 will respectively bears on the inner wall of tank 14 to maintain the dispensing device in normal mounting position and inverted position as described above in a flushing cycle. In the absence of bracket 12, the elongated member including a hook 133 is pivoted directly on the pivotal pins 11,11 to permit pivoting of the dispensing device.

While the invention has been described in connection with what is presently considered to be the most practical and prefered embodiments, it is to be understood that the invention is not to be limited to the disclosed embodiments, but on the contrary, is intended to cover various modifications and equivalent arrangements included within the spirit and scope of the appended claims which scope is to be accorded the broadest interpretation so as to encompass all such modification and equivalent structures.

I claim:

1. A device for dispensing liquid cleanser into a toilet tank, comprising:

a container including a first chamber having a through bore and a second chamber associated with said first chamber yet not communicated therewith for storing liquid to be dispensed, said second chamber formed with an upstanding fill tube portion extending through said bore of said first chamber;

a dispensing member provided in said fill tube portion, which member has a tortuous passage ending in an outlet orifice, by which a quantity of liquid defined by the dimensions of said tortuous passage will dispense from said orifice into the toilet tank;

an adjustable mounting means, detachably mounted to said toilet tank and privotably connected to said second chamber at two ends thereof such that when the tank is full said container will be held in the tank water in a normal position with the upper end of said fill tube disposed above the highest flush water level within said toilet tank and when the tank water level recedes during flushing said first chamber and said second chamber will pivot with respect to said mounting as a unit about said pivotal connection to dispense a predetermined quantity of liquid defined by the dimensions of said tortuous passage.

2. A device for dispensing liquid cleanser applied to toilet tank as claimed in claim 3, wherein said tortuous passage includes a plurality of transverse and vertical passage sections which communicate and provide additional resistance to the liquid cleanser contained in said second chamber, thereby only a predetermined portion of the liquid cleanser filled in said tortuous passage will discharge into the toilet tank during a flushing cycle.

* * * * *